US011151958B2

(12) United States Patent
Huang

(10) Patent No.: US 11,151,958 B2
(45) Date of Patent: Oct. 19, 2021

(54) DRIVING METHOD AND DRIVING APPARATUS OF DISPLAY PANEL, AND DISPLAY APPARATUS

(71) Applicant: HKC Corporation Limited, Shenzhen (CN)

(72) Inventor: Bei Zhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/772,343

(22) PCT Filed: Aug. 1, 2018

(86) PCT No.: PCT/CN2018/097934
§ 371 (c)(1),
(2) Date: Jun. 12, 2020

(87) PCT Pub. No.: WO2019/119813
PCT Pub. Date: Jun. 27, 2019

(65) Prior Publication Data

US 2020/0312265 A1 Oct. 1, 2020

(30) Foreign Application Priority Data

Dec. 18, 2017 (CN) ..... 201711369010.2

(51) Int. Cl.
*G09G 3/36* (2006.01)

(52) U.S. Cl.
CPC ..... *G09G 3/3696* (2013.01); *G09G 3/3614* (2013.01)

(58) Field of Classification Search
CPC combination set(s) only.
See application file for complete search history.

(56) References Cited

U.S. PATENT DOCUMENTS 10,297,215 B2 * 5/2019 Chen ..... G09G 3/3607
2006/0267897 A1 * 11/2006 Lin ..... G09G 3/3614 345/96

FOREIGN PATENT DOCUMENTS

CN 101271207 A 9/2008
CN 107301853 A 10/2017

* cited by examiner

*Primary Examiner* — Van N Chow
(74) *Attorney, Agent, or Firm* — WPAT, PC

(57) ABSTRACT

A driving method and a driving apparatus of a display panel and a display apparatus are provided. The display panel includes adjacently disposed several first pixel units and several second pixel units. The driving method includes: dividing multiple pixel units of the display panel into multiple pixel unit groups each including adjacent two rows of pixel units; using driving voltages of different voltage levels to drive each sub-pixel of a first pixel unit and each sub-pixel of a second pixel unit; using driving voltages of opposite polarities to drive sub-pixels arranged in a same column in each adjacent two of the pixel unit groups; and using driving voltages with a same polarity distribution to drive adjacent two columns of pixel units of each successively arranged three columns of pixel units in a same pixel unit group.

15 Claims, 8 Drawing Sheets

20

| | | | | | | |
|---|---|---|---|---|---|---|
| n | P1(i, j)<br>H | P2(i, j+1)<br>L | P1(i, j+2)<br>H | P2(i, j+3)<br>L | P1(i, j+4)<br>H | P2(i, j+5)<br>L |
| | P2(i+1, j)<br>L | P1(i+1, j+1)<br>H | P2(i+1, j+2)<br>L | P1(i+1, j+3)<br>H | P2(i+1, j+4)<br>L | P1(i+1, j+5)<br>H |
| n+1 | P1(i+2, j)<br>H | P2(i+2, j+1)<br>L | P1(i+2, j+2)<br>H | P2(i+2, j+3)<br>L | P1(i+4, j+4)<br>H | P2(i+4, j+5)<br>L |
| | P2(i+3, j)<br>L | P1(i+3, j+1)<br>H | P2(i+3, j+2)<br>L | P1(i+2, j+3)<br>H | P2(i+5, j+4)<br>L | P1(i+4, j+5)<br>H |

20

| | C11 | | | C12 | | | C13 | | |
|---|---|---|---|---|---|---|---|---|---|
| n | R1 H+ (i, j) | G1 H− (i, j) | B1 H+ (i, j) | R2 L− (i, j+1) | G2 L+ (i, j+1) | B2 L− (i, j+1) | R1 H− (i, j+2) | G1 H+ (i, j+2) | B1 H− (i, j+2) |
| | R2 L+ (i+1, j) | G2 L− (i+1, j) | B2 L+ (i+1, j) | R1 H− (i+1, j+1) | G1 H+ (i+1, j+1) | B1 H− (i+1, j+1) | R2 L− (i+1, j+2) | G2 L+ (i+1, j+2) | B2 L− (i+1, j+2) |
| n+1 | R1 H− (i+2, j) | G1 H+ (i+2, j) | B1 H− (i+2, j) | R2 L+ (i+2, j+1) | G2 L− (i+2, j+1) | B2 L+ (i+2, j+1) | R1 H+ (i+2, j+2) | G1 H− (i+2, j+2) | B1 H+ (i+2, j+2) |
| | R2 L− (i+3, j) | G2 L+ (i+3, j) | B2 L− (i+3, j) | R1 H+ (i+3, j+1) | G1 H− (i+3, j+1) | B1 H+ (i+3, j+1) | R2 L+ (i+3, j+2) | G2 L− (i+3, j+2) | B2 L+ (i+3, j+2) |
| | C21 | | | C22 | | | C23 | | |

FIG. 3

20

| | | | | | | | | | |
|---|---|---|---|---|---|---|---|---|---|
| n | R1 H− (i, j) | G1 H+ (i, j) | B1 H− (i, j) | R2 L+ (i, j+1) | G2 L− (i, j+1) | B2 L+ (i, j+1) | R1 H+ (i, j+2) | G1 H− (i, j+2) | B1 H+ (i, j+2) |
| | R2 L− (i+1, j) | G2 L+ (i+1, j) | B2 L− (i+1, j) | R1 H+ (i+1, j+1) | G1 H− (i+1, j+1) | B1 H+ (i+1, j+1) | R2 L+ (i+1, j+2) | G2 L− (i+1, j+2) | B2 L+ (i+1, j+2) |
| n+1 | R1 H+ (i+2, j) | G1 H− (i+2, j) | B1 H+ (i+2, j) | R2 L− (i+2, j+1) | G2 L+ (i+2, j+1) | B2 L− (i+2, j+1) | R1 H− (i+2, j+2) | G1 H+ (i+2, j+2) | B1 H− (i+2, j+2) |
| | R2 L+ (i+3, j) | G2 L− (i+3, j) | B2 L+ (i+3, j) | R1 H− (i+3, j+1) | G1 H+ (i+3, j+1) | B1 H− (i+3, j+1) | R2 L− (i+3, j+2) | G2 L+ (i+3, j+2) | B2 L− (i+3, j+2) |

FIG. 4

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H− | G1 H+ | B1 H− | R2 L+ | G2 L− | B2 L+ | R1 H+ | G1 H− | B1 H+ | R2 L− | G2 L+ | B2 L− |
| R2 L− | G2 L+ | B2 L− | R1 H+ | G1 H− | B1 H+ | R2 L+ | G2 L− | B2 L+ | R1 H− | G1 H+ | B1 H− |

FIG. 5a

| | | | | | | | | | | | |
|---|---|---|---|---|---|---|---|---|---|---|---|
| R1 H− | G1 H+ | B1 H− | R2 L− | G2 L+ | B2 L− | R1 H+ | G1 H− | B1 H+ | R2 L− | G2 L+ | B2 L− |
| R2 L− | G2 L+ | B2 L− | R1 H− | G2 H+ | B1 H− | R2 L+ | G2 L− | B2 L+ | R1 H− | G1 H+ | B1 H− |
| R1 H+ | G1 H− | B1 H+ | R2 L+ | G2 L− | B2 L+ | R1 H− | G1 H+ | B1 H− | R2 L+ | G2 L− | B2 L+ |
| R2 L+ | G2 L− | B2 L+ | R1 H+ | G1 H− | B1 H+ | R2 L− | G2 L+ | B2 L− | R1 H+ | G1 H− | B1 H+ |

FIG. 5b

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H− | G1 H+ | B1 H− | R2 L+ | G2 L− | B2 L+ | R1 H+ | G1 H− | B1 H+ | R2 L− | G2 L+ | B2 L− |
| R2 L− | G2 L+ | B2 L− | R1 H+ | G1 H− | B1 H+ | R2 L+ | G2 L− | B2 L+ | R1 H− | G1 H+ | B1 H− |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H− | G1 H+ | B1 H− | R2 L+ | G2 L− | B2 L+ | R1 H+ | G1 H− | B1 H+ | R2 L− | G2 L+ | B2 L− |
| R2 L− | G2 L+ | B2 L− | R1 H+ | G1 H− | B1 H+ | R2 L+ | G2 L− | B2 L+ | R1 H− | G1 H+ | B1 H− |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G1 H+ | B1 H− | R2 L− | G2 L+ | B2 L− | R1 H+ | G1 H− | B1 H+ |

FIG. 5c

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H− | G1 H+ | B1 H− | R2 L+ | G2 L− | B2 L+ | R1 H+ | G1 H− | B1 H+ | R2 L− | G2 L+ | B2 L− |
| R2 L− | G2 L+ | B2 L− | R1 H+ | G1 H− | B1 H+ | R2 L+ | G2 L− | B2 L+ | R1 H− | G1 H+ | B1 H− |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |

FIG. 5d

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H− | G1 H+ | B1 H− | R2 L+ | G2 L− | B2 L+ | R1 H+ | G1 H− | B1 H+ | R2 L− | G2 L+ | B2 L− |
| R2 L− | G2 L+ | B2 L− | R1 H+ | G1 H− | B1 H+ | R2 L+ | G2 L− | B2 L+ | R1 H− | G1 H+ | B1 H− |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |

FIG. 5e

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H− | G1 H+ | B1 H− | R2 L+ | G2 L− | B2 L+ | R1 H+ | G1 H− | B1 H+ | R2 L− | G2 L+ | B2 L− |
| R2 L− | G2 L+ | B2 L− | R1 H+ | G2 H− | B1 H+ | R2 L+ | G2 L− | B2 L+ | R1 H− | G1 H+ | B1 H− |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |

FIG. 5f

| | | | | | | | | | | | |
|---|---|---|---|---|---|---|---|---|---|---|---|
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |
| R1 H− | G1 H+ | B1 H− | R2 L+ | G2 L− | B2 L+ | R1 H+ | G1 H− | B1 H+ | R2 L− | G2 L+ | B2 L− |
| R2 L− | G2 L+ | B2 L− | R1 H+ | G2 H− | B1 H+ | R2 L+ | G2 L− | B2 L+ | R1 H− | G1 H+ | B1 H− |
| R1 H+ | G1 H− | B1 H+ | R2 L− | G2 L+ | B2 L− | R1 H− | G1 H+ | B1 H− | R2 L+ | G2 L− | B2 L+ |
| R2 L+ | G2 L− | B2 L+ | R1 H− | G2 H+ | B1 H− | R2 L− | G2 L+ | B2 L− | R1 H+ | G1 H− | B1 H+ |

FIG. 5g

| | | | | | | | | | | | |
|---|---|---|---|---|---|---|---|---|---|---|---|
| R1<br>H+ | G1<br>H− | B1<br>H+ | R2<br>L− | G2<br>L+ | B2<br>L− | R1<br>H− | G1<br>H+ | B1<br>H− | R2<br>L+ | G2<br>L− | B2<br>L+ |
| R2<br>L+ | G2<br>L− | B2<br>L+ | R1<br>H− | G2<br>H+ | B1<br>H− | R2<br>L− | G2<br>L+ | B2<br>L− | R1<br>H+ | G1<br>H− | B1<br>H+ |
| R1<br>H− | G1<br>H+ | B1<br>H− | R2<br>L+ | G2<br>L− | B2<br>L+ | R1<br>H+ | G1<br>H− | B1<br>H+ | R2<br>L− | G2<br>L+ | B2<br>L− |
| R2<br>L− | G2<br>L+ | B2<br>L− | R1<br>H+ | G2<br>H− | B1<br>H+ | R2<br>L+ | G2<br>L− | B2<br>L+ | R1<br>H− | G1<br>H+ | B1<br>H− |
| R1<br>H+ | G1<br>H− | B1<br>H+ | R2<br>L− | G2<br>L+ | B2<br>L− | R1<br>H− | G1<br>H+ | B1<br>H− | R2<br>L+ | G2<br>L− | B2<br>L+ |
| R2<br>L+ | G2<br>L− | B2<br>L+ | R1<br>H− | G2<br>H+ | B1<br>H− | R2<br>L− | G2<br>L+ | B2<br>L− | R1<br>H+ | G1<br>H− | B1<br>H+ |

FIG. 5h

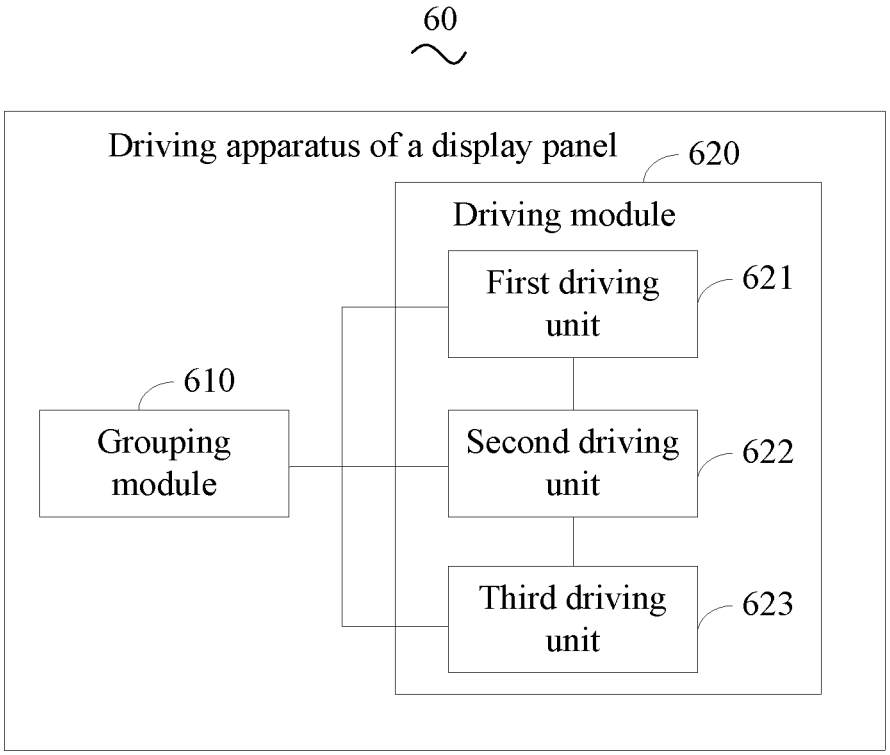

FIG. 6

DRIVING METHOD AND DRIVING APPARATUS OF DISPLAY PANEL, AND DISPLAY APPARATUS

FIELD OF THE DISCLOSURE

The disclosure relates to the field of display technology, and more particularly to a driving method of a display panel, a driving apparatus of a display panel and a display apparatus.

BACKGROUND

In an exemplary vertical alignment (VA) liquid crystal display device, during displaying an image, liquid crystal molecules maintain certain deflection angles so that light transmittances at different viewing angles are different, which would cause the user to feel a color shift phenomenon that colors of an image observed at different viewing angles are different.

In order to improve the color shift, it is a common practice to divide each of pixel electrodes of RGB sub-pixels in each pixel unit into two independent pixel electrodes and apply different driving voltages onto the two pixel electrodes to improve the color shift. In this method, as the number of the pixel electrodes increases, more metal wires or TFT (thin film transistor) elements are additionally required for driving the display panel. Moreover, since the metal wires and the TFT elements are opaque, the method would sacrifice the light-transmissive aperture area, affect the transmittance of panel and increase the backlight cost.

In order to avoid the increase of metal wires or TFT elements, another method is to apply two high and low different driving voltage signals respectively onto each adjacent two pixel units. Specifically, at the same time, every adjacent two sub-pixels are applied with driving voltages of different polarities. In this way, positive and negative polarities of high voltages of a same row of sub-pixels are mismatched, i.e., the number of sub-pixels with positive high voltages is inconsistent with the number of the sub-pixels with negative high voltages in the same row. As such, due to the influence of parasitic capacitance, in a same row, when the number of sub-pixels with positive high voltages is greater than the number of sub-pixels with negative high voltages, an equivalent voltage of a common voltage Vcom is increased with respect to the original Vcom, so that actually charged charges of the sub-pixels with positive high voltages decrease and their luminances decrease correspondingly; on the contrary, actually charged charges of the sub-pixels with negative high voltage increase and their luminances increase correspondingly. Display color and quality would be affected and abnormal image output would be induced.

SUMMARY

Accordingly, it is necessary to provide a driving method of a display panel, a driving apparatus of a display panel and a display apparatus, so as to prevent the Vcom voltage from being interfered, ensure the correctness of the image signal and improve the picture display quality.

A driving method of a display panel includes: dividing a plurality of pixel units of a display panel into a plurality of pixel unit groups, wherein each of the pixel unit groups includes adjacent two rows of pixel units; using driving voltages of different voltage levels to drive sub-pixels of a first pixel unit and sub-pixels of a second pixel unit; using driving voltages of opposite polarities to drive sub-pixels arranged in a same column in each adjacent two of the pixel unit groups; and using driving voltages with a same polarity distribution to drive adjacent two columns of pixel units of each successively arranged three columns of pixel units in a same one of the pixel unit groups. The first pixel unit and the second pixel unit are adjacently disposed in the display panel.

In an embodiment, the driving method further includes: dividing each of the pixel unit groups into a plurality of unit sub-groups, wherein each of the unit sub-groups includes six pixel units arranged in three columns and two rows, and the six pixel units arranged in three columns and two rows include a first column of pixel units, a second column of pixel units and a third column of pixel units sequentially arranged in that order. The step of using driving voltages with a same polarity distribution to drive adjacent two columns of pixel units of each successively arranged three columns of pixel units in a same one of the pixel unit groups includes: using driving voltages having a polarity distribution opposite to a polarity distribution of driving voltages for the first column of pixel units to drive the second column of pixel units and the third column of pixel units in the same one of the unit sub-groups.

In an embodiment, sub-pixels of each of the pixel units include a first sub-pixel, a second sub-pixel and a third sub-pixel sequentially arranged in that order. The step of using driving voltages having a polarity distribution opposite to a polarity distribution of driving voltages for the first column of pixel units to drive the second column of pixel units and the third column of pixel units in the same one of the unit sub-groups includes: in the same unit sub-group, using driving voltages having a polarity opposite to a polarity of driving voltages for the first sub-pixels in the first column of pixel units to drive the first sub-pixels in the second column of pixel units and the first sub-pixels in the third column of pixel units; in the same unit sub-group, using driving voltages having a polarity opposite to a polarity of driving voltages for the second sub-pixels in the first column of pixel units to drive the second sub-pixels in the second column of pixel units and the second sub-pixels in the third column of pixel units; and in the same unit sub-group, using driving voltages having a polarity opposite to a polarity of driving voltages for the third sub-pixels in the first column of pixel units to drive the third sub-pixels in the second column of pixel units and the third sub-pixels in the third column of pixel units.

In an embodiment, the driving method further includes: dividing each of the pixel unit groups into a plurality of unit sub-groups, wherein each of the unit sub-groups includes six pixel units arranged in three columns and two rows, and the six pixel units arranged in three columns and two rows include a first column of pixel units, a second column of pixel units and a third column of pixel units sequentially arranged in that order. The step of using driving voltages with a same polarity distribution to drive adjacent two columns of pixel units of each successively arranged three columns of pixel units in a same one of the pixel unit groups includes: using driving voltages having a polarity distribution opposite to a polarity distribution of driving voltages for the third column of pixel units to drive the first column of pixel units and the second column of pixel units in the same one of the unit sub-groups.

In an embodiment, the driving method further includes: using driving voltages of different polarities to respectively drive each adjacent two sub-pixels in a same pixel unit.

In an embodiment, the driving method further includes: in each adjacent two frame display periods, using driving voltages of opposite polarities to alternately drive a same sub-pixel.

A driving apparatus of a display panel includes: a grouping module, configured to divide a plurality of pixel units of a display panel into a plurality of pixel unit groups, wherein each of the pixel unit groups includes adjacent two rows of pixel units; and a driving module. The driving module includes: a first driving unit, configured to use driving voltages of different voltage levels to drive sub-pixels of a first pixel unit and sub-pixels of a second pixel unit; a second driving unit, configured to use driving voltages of opposite polarities to drive sub-pixels arranged in a same column in each adjacent two of the pixel unit groups; and a third driving unit, configured to use driving voltages with a same polarity distribution to drive adjacent two columns of pixel units of each successively arranged three columns of pixel units in a same one of the pixel unit groups. The first pixel unit and the second pixel unit are adjacently disposed in the display panel.

In an embodiment, the grouping module is further configured to: divide each of the pixel unit groups into a plurality of unit sub-groups, wherein each of the unit sub-groups includes six pixel units arranged in three columns and two rows, and the six pixel units arranged in three columns and two rows include a first column of pixel units, a second column of pixel units and a third column of pixel units sequentially arranged in that order. The third driving unit is configured to: use driving voltages having a polarity distribution opposite to a polarity distribution of driving voltages for the first column of pixel units to drive the second column of pixel units and the third column of pixel units in the same one of the unit sub-groups.

In an embodiment, sub-pixels of each of the pixel units include a first sub-pixel, a second sub-pixel and a third sub-pixel sequentially arranged in that order. The third driving unit includes: a first driving sub-unit, configured to: in the same unit sub-group, use driving voltages having a polarity opposite to a polarity of driving voltages for the first sub-pixels in the first column of pixel units to drive the first sub-pixels in the second column of pixel units and the first sub-pixels in the third column of pixel units; a second driving sub-unit, configured to: in the same unit sub-group, use driving voltages having a polarity opposite to a polarity of driving voltages for the second sub-pixels in the first column of pixel units to drive the second sub-pixels in the second column of pixel units and the second sub-pixels in the third column of pixel units; and a third driving sub-unit, configured to: in the same unit sub-group, use driving voltages having a polarity opposite to a polarity of driving voltages for the third sub-pixels in the first column of pixel units to drive the third sub-pixels in the second column of pixel units and the third sub-pixels in the third column of pixel units.

In an embodiment, the grouping module is further configured to: divide each of the pixel unit groups into a plurality of unit sub-groups, wherein each of the unit sub-groups includes six pixel units arranged in three columns and two rows, and the six pixel units arranged in three columns and two rows include a first column of pixel units, a second column of pixel units and a third column of pixel units sequentially arranged in that order. The third driving unit is configured to: use driving voltages having a polarity distribution opposite to a polarity distribution of driving voltages for the third column of pixel units to drive the first column of pixel units and the second column of pixel units in the same one of the unit sub-groups.

In an embodiment, the driving module further includes: a fourth driving unit, configured to use driving voltages of different polarities to respectively drive each adjacent two sub-pixels in a same pixel unit.

In an embodiment, the driving module further includes: a fifth driving unit, configured to: in each adjacent two frame display periods, use driving voltages of opposite polarities to alternately drive a same sub-pixel.

In an embodiment, the first driving unit is configured to: apply driving voltages with a preset first voltage level to sub-pixels in the first pixel unit, and apply driving voltages with a preset second voltage level to the sub-pixels of the second pixel unit.

A display apparatus includes a display panel and a driving apparatus of a display panel as that of any of the above embodiments.

The above described driving method and driving apparatus of a display panel and the above described display apparatus can make that in each row, the number of sub-pixels applied with driving voltages of positive high voltage level is equal to the number of sub-pixels applied with driving voltages of negative high voltage level, so that the Vcom voltage is prevented from the impact of parasitic capacitance and thereby correctness of image signal is ensured and the occurrence of color shift or abnormal image quality is avoided.

BRIEF DESCRIPTION OF THE DRAWINGS

FIG. 3 is a schematic view of driving voltages of sub-pixels of multiple pixel units in a display panel of an embodiment.

FIG. 4 is a schematic view of driving voltages of sub-pixels of multiple pixel units in a display panel of another embodiment.

FIG. 5*a* is a schematic view of driving voltages of multiple pixel units when a display panel displays a particular image according to an embodiment.

FIG. 5*b* is a schematic view of driving voltages of multiple pixel units when a display panel displays another particular image according to an embodiment.

FIG. 5*c* is a schematic view of driving voltages of multiple pixel units when a display panel displays still another particular image according to an embodiment.

FIG. 5*d* is a schematic view of driving voltages of multiple pixel units when a display panel displays even still another particular image according to an embodiment.

FIG. 5*e* is a schematic view of driving voltages of multiple pixel units when a display panel displays further another particular image according to an embodiment.

FIG. 5*f* is a schematic view of driving voltages of multiple pixel units when a display panel displays still further another particular image according to an embodiment.

FIG. 5*g* is a schematic view of driving voltages of multiple pixel units when a display panel displays even still further another particular image according to an embodiment.

FIG. 5*h* is a schematic view of driving voltages of multiple pixel units when a display panel displays even further another particular image according to an embodiment.

FIG. 6 is a schematic structural view of a driving apparatus of a display panel of an embodiment.

DETAILED DESCRIPTION OF EMBODIMENTS

Figures 1, 2:
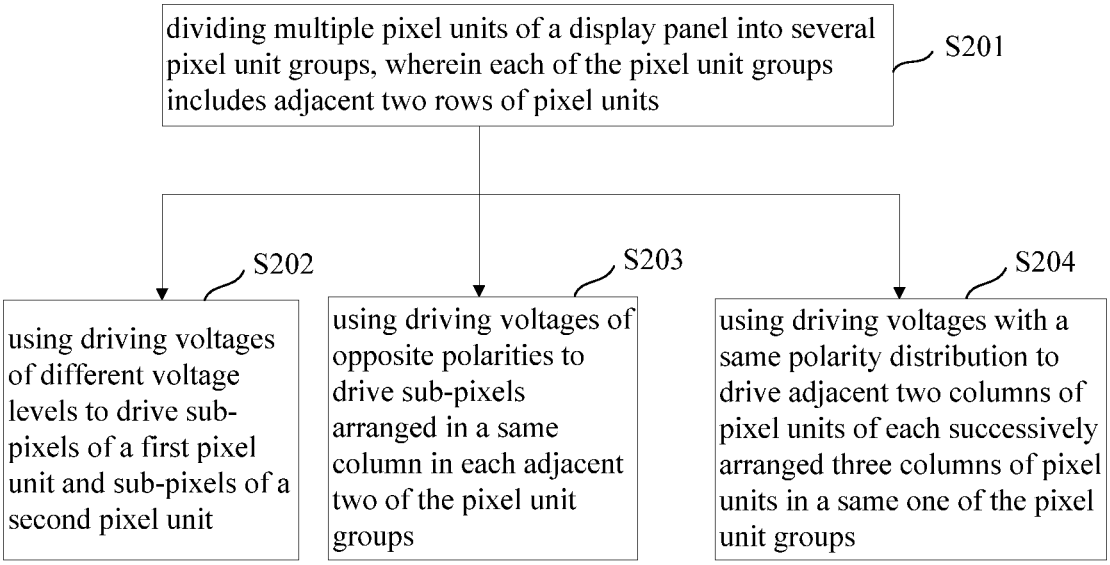
FIG. 1 is a flow chart of a driving method of a display panel of an embodiment.
FIG. 2 is a schematic view of driving voltages of multiple pixel units in a display panel of an embodiment.

In order to facilitate understanding of the disclosure, the disclosure will be described more fully hereinafter with reference to the accompanying drawings. Preferred embodiments of the disclosure are given in the drawings. However, the disclosure may be embodied in many different forms and is not limited to the embodiments described herein. Rather, the embodiments are provided are provided with the purpose of providing a more thorough and comprehensive understanding of the disclosed content of the disclosure.

Unless otherwise defined, all technical and scientific terms used herein have the same meaning as commonly understood by those skilled in the art to which the disclosure pertains. The terminologies used herein in the specification of the disclosure are merely for the purpose of describing specific embodiments, and are not intended to limit the disclosure. The term "and/or" as used herein includes any and all of combinations of one or more related listed items.

For example, a driving method of a display panel includes: dividing multiple (i.e., more than one) pixel units of a display panel into several pixel unit groups, to make each of the pixel unit groups include adjacent two rows of pixel units; using driving voltages of different voltage levels to drive each sub-pixel in a first pixel unit and each sub-pixel in a second pixel unit; using driving voltages of opposite polarities to respectively drive sub-pixels arranged in a same column of each adjacent two pixel unit groups; and using driving voltages with a same polarity distribution to drive adjacent two columns of pixel units in each successively arranged three columns of pixel units of a same one of the pixel unit groups. The first pixel unit and the second pixel unit are adjacently disposed in the display panel. Or, applying driving voltages on sub-pixels in the display panel, to make each sub-pixel in the first pixel unit and each sub-pixel in the second pixel unit have different driving voltage levels, make the sub-pixels arranged in a same column in each adjacent two pixel unit groups have opposite driving voltage polarities, and make each successively arranged three columns of pixel units in a same pixel unit group have adjacent two columns of pixel units with a same polarity distribution.

For example, a driving apparatus of a display panel includes: a grouping module and a driving module. The driving module includes a first driving unit, a second driving unit and a third driving unit. The grouping module is configured (i.e., structured and arranged) for dividing multiple pixel units into several pixel unit groups, to make each pixel unit group include adjacent two rows of pixel units. The first driving unit is configured for using driving voltages of different voltage levels to drive each sub-pixel in a first pixel unit and each sub-pixel in a second pixel unit. The second driving unit is configured for using driving voltages of opposite polarities to respectively drive sub-pixels arranged in a same column in each adjacent two pixel unit groups. The third driving unit is configured for using driving voltages with a same polarity distribution to drive adjacent two columns of pixel units in each successively arranged three columns of pixel units of a same pixel unit group. The first pixel unit and the second pixel unit are adjacently disposed in the display panel.

For example, a display apparatus includes a display panel and the above driving apparatus of a display panel.

In order to further understand the driving method of a display panel, the driving apparatus of a display panel and the display apparatus, descriptions with reference to the drawings will be given in the following.

Referring to FIG. 1 through FIG. 3, FIG. 1 is a flow chart of a driving method of a display panel according to an embodiment of the disclosure. As shown in FIG. 1, the driving method 20 include following steps:

S201: dividing multiple pixel units of a display panel into several pixel unit groups, wherein each of the pixel unit groups includes adjacent two rows of pixel units;

S202: using driving voltages of different voltage levels to drive sub-pixels of a first pixel unit and sub-pixels of a second pixel unit;

S203: using driving voltages of opposite polarities to drive sub-pixels arranged in a same column in each adjacent two of the pixel unit groups;

S204: using driving voltages with a same polarity distribution to drive adjacent two columns of pixel units in each successively arranged three columns of pixel units of a same one of the pixel unit groups.

In an actual application, the step S202, the step S203 and the step S204 may be executed simultaneously. For example, in a display period of a same frame image, sub-pixels of the display panel respectively are applied with driving voltages, so as to make the sub-pixels of the first pixel unit has a driving voltage level different from a driving voltage level for the sub-pixels of the second pixel unit, make the sub-pixels arranged in a same column in each adjacent two pixel unit groups have opposite driving voltage polarities, and make each successively arranged three columns of pixel units in a same pixel unit group have adjacent two pixel units with a same driving voltage polarity distribution. The different voltage levels include a preset high voltage level and a preset low voltage level. As such, in each row of pixel units of a liquid crystal panel, the number of sub-pixels applied with positive driving voltages of high voltage level is equal to the number of sub-pixels applied with negative driving voltages of high voltage level, so that the Vcom voltage is prevented from the impact of parasitic capacitance and thereby correctness of image signal is ensured and the occurrence of color shift or abnormal image quality is avoided.

Column and row in the embodiment of the disclosure represent two kinds of arrangement directions mutually perpendicular to each other. For example, column represents a vertical direction, and row represents a horizontal direction; for another example, column represents a horizontal direction, and row represents a vertical direction. That is, "column" in the embodiment of the disclosure may be "row" as understood by those skilled in the art, and "row" in the embodiment of the disclosure may also be "column" as understood by those skilled in the art.

As shown in FIG. 2, the display panel 20 has multiple pixel units arranged in an array. The multiple pixel units include several first pixel units P1 and several second pixel units P2. The first pixel unit and the second pixel unit are adjacently disposed; or, the first pixel unit and the second pixel unit are alternately arranged. For example, as shown in FIG. 2, pixel units adjacent to any one first pixel unit all are second pixel units, and pixel units adjacent to any one second pixel unit all are first pixel units. More specifically, each pixel unit includes multiple sub-pixels, for example, each pixel unit includes multiple sub-pixels of different colors; or, each pixel unit includes three kinds of sub-pixels such as red sub-pixel R, green sub-pixel G and blue sub-pixel B. As shown in FIG. 2, an ith row through an (i+3)th row, in total four rows of pixel units are divided into two pixel unit groups respectively being an nth pixel unit group and an (n+1)th pixel unit group, so that each pixel unit group includes adjacent two rows of pixel units. For example, the nth pixel unit group includes adjacent ith row and (i+1)th row pixel units, the (n+1)th pixel unit group includes adjacent (i+2)th row and (i+3)th row pixel units. (i, j) represents ith row jth column, (i, j+1) represents ith row (j+1)th column, (i+1, j) represents (i+1)th row jth column, and so on.

According to the above driving method, driving voltages of different voltage levels are used to drive each sub-pixel in the first pixel unit and each sub-pixel in the second pixel unit, that is, the sub-pixels in the first pixel unit and the sub-pixels in the second pixel unit respectively are applied with the driving voltages of different voltage levels. For example, a driving voltage with a preset first voltage level is applied onto the sub-pixels in the first pixel unit, and a driving voltage with a preset second voltage level is applied onto the sub-pixels in the second pixel unit. It may preset driving voltage levels respectively corresponding to the first pixel unit and the second pixel unit, e.g., presets a first driving voltage level corresponding to the first pixel unit and a second driving voltage level corresponding to the second pixel unit. For the first driving voltage level and the second driving voltage level, one is a high voltage level, and the other one is a low voltage level. For example, the first driving voltage level is higher than the second driving voltage level, or the first driving voltage level is lower than the second driving voltage level.

According to the above driving method, driving voltages of opposite polarities are used to respectively drive sub-pixels arranged in a same column in each adjacent two pixel unit groups; that is, in each adjacent two pixel unit groups, the sub-pixels arranged in the same column are applied with the driving voltages of opposite polarities respectively. For example, as shown in FIG. 3, the nth pixel unit group and the (n+1)th pixel unit group are adjacent two pixel unit groups, the sub-pixels in the same column and respectively belong to the nth pixel unit group and the (n+1)th pixel unit group are applied with the driving voltages of opposite polarities, e.g., as to the sub-pixels R in the jth column, the ones belonging to the nth pixel unit group are applied with driving voltages of positive polarity, and the other ones belonging to the (n+1)th pixel unit group are applied with driving voltages of negative polarity, so that the sub-pixels arranged in a same column and respectively belonging to adjacent two pixel unit groups are applied with driving voltages of opposite polarities.

According to the above driving method, driving voltages with a same polarity distribution are used to drive adjacent two columns of pixel units in each successively arranged three columns of pixel units in a same pixel unit group; that is, the two adjacent columns of pixel units in each successively arranged three columns of pixel units in the same pixel unit group are applied with two groups of driving voltages with the same polarity distribution, so that each successively arranged three columns of pixel units in the same pixel unit group have adjacent two columns of pixel units with driving voltages of a same polarity distribution. Herein, different pixel units having driving voltages of a same polarity distribution means that sub-pixels with corresponding arrangement positions in the different pixel units have driving voltages of a same polarity. For example, each pixel unit includes a first sub-pixel, a second sub-pixel and a third sub-pixel sequentially arranged in that order, if the first sub-pixels of the two pixel units have driving voltages of a same polarity, the second sub-pixels of the two pixel units have driving voltages of a same polarity, and the third sub-pixels of the two pixel units have driving voltages of a same polarity, it is considered as the two pixel units having driving voltages of a same polarity (also referred to as having a same polarity distribution), or else, it is considered as polarity distributions of driving voltages of the two pixel units being different.

As shown in FIG. 3, the nth pixel unit group is taken as an example, C11, C12 and C13 are successively arranged three columns of pixel units in the nth pixel unit group, polarities of driving voltages of sequentially arranged three sub-pixels in the pixel unit at the column C12 respectively are negative (−), positive (+), and negative (−); polarities of driving voltages of sequentially arranged three sub-pixels in the pixel unit at the column C13 respectively are negative (−), positive (+), and negative (−), so that driving voltages of the adjacent C12 column pixel unit and the driving voltages of the C13 column pixel unit have a same polarity distribution.

R1, G1 and B1 respectively represent a red sub-pixel, a green sub-pixel and a blue sub-pixel in the first pixel unit. R2, G2 and B2 respectively represent a red sub-pixel, a green sub-pixel and a blue sub-pixel in the second pixel unit. H represents a first voltage level, L represents a second voltage level, + represents positive polarity, and − represents negative polarity. (i, j) represents ith row jth column, (i, j+1) represents ith row (j+1)th column, (i+1, j) represents (i+1)th row jth column, and so on. In the illustrated embodiment, the positive polarity represents the value of the driving voltage is greater than a preset common voltage Vcom of the liquid crystal panel, i.e., a voltage difference of the driving voltage relative to the Vcom voltage is greater than zero. The negative polarity represents the value of the driving voltage is lower than the Vcom voltage, i.e., a voltage difference of the driving voltage relative to the Vcom voltage is smaller than zero.

When the above driving method is adopted, it can make that in each row of pixel units of the liquid crystal panel, the number of the sub-pixels applied with driving voltages of positive high voltage level (H+) is equal to the number of the sub-pixels applied with driving voltages of negative high voltage level (H−). For example, as to each row in FIG. 3, the number of the sub-pixels applied with the positive high voltage level (H+) and the number of the sub-pixels applied with the negative high voltage level (H−) each is three. The number of sub-pixels applied with positive high voltage level and the number of sub-pixels applied with negative high voltage level being equal can prevent the Vcom voltage from being affected by parasitic capacitance, so that correctness of image signal is ensured and the occurrence of color shift or abnormal image quality is avoided.

In an embodiment, the above driving method further includes: dividing each pixel unit group into several unit sub-groups, to make each unit sub-group includes six pixel units arranged in three columns and two rows. The six pixel units arranged in three columns and two rows include a first column of pixel units, a second column of pixel units and a third column of pixel units sequentially arranged in that order. As shown in FIG. 3, the pixel units in the columns C11 through C13 in the nth pixel unit group belong to one unit sub-group, the pixel units in the columns C21 through C23 in the (n+1)th pixel unit group belong to another unit sub-group, and the two unit sub-groups are adjacent to each other and each include six pixel units arranged in three columns and two rows. As an exemplary embodiment, driving voltages with a polarity distribution opposite to that of driving voltages for the first column of pixel units are used to drive the second column of pixel units and the third column of pixel units in the same unit sub-group; or, driving voltages with a polarity distribution opposite to that of driving voltages for the third column of pixel units are used to drive the first column of pixel units and the second column of pixel units in a same unit sub-group. That is, in a same unit sub-group, the second column of pixel units and the third column of pixel units are applied with driving voltages having a polarity distribution opposite to that of driving voltages applied onto the first column of pixel units; or, in a same unit sub-group, the first column of pixel units and the second column of pixel units are applied with driving voltages having a polarity distribution opposite to that of driving voltages applied onto the third column of pixel units. As such, it can ensure in the same pixel unit group, each successively arranged three columns of pixel units have adjacent two columns of pixel units with driving voltages of a same polarity distribution. Moreover, in a same column, driving voltage changes by taking every two sub-pixels as a unit, so as to avoid frequent and wide-range jumping of multiple voltages outputted from a same data line, and thereby avoid heating or voltage signal distortion of a data driver chip and further improve the display quality of sub-pixels.

For example, each pixel unit includes a first sub-pixel, a second sub-pixel and a third sub-pixel sequentially arranged in that order. When the second column of pixel units and the third column of pixel units in a same unit sub-group being applied with driving voltages having a polarity distribution opposite to that of driving voltages applied onto the first column of pixel units is taken as an example, in the same unit sub-group, driving voltages having a polarity opposite to that of the first sub-pixels in the first column of pixel units are used to drive the first sub-pixels in the second column of pixel units and the first sub-pixels in the third column of pixel unit; in the same unit sub-group, driving voltages having a polarity opposite to that of the second sub-pixels in the first column of pixel units are used to drive the second sub-pixels in the second column of pixel units and the second sub-pixels in the third column of pixel unit; and in the same unit sub-group, driving voltages having a polarity opposite to that of the third sub-pixels in the first column of pixel units are used to drive the third sub-pixels in the second column of pixel units and the third sub-pixels in the third column of pixel unit.

As shown in FIG. 3, the first column of pixel unit C11, the second column of pixel units C12 and the third column of pixel units C13 are three columns of pixel units in a same unit sub-group. The sub-pixels R, the sub-pixels G and the sub-pixels B in the first column of pixel units C11 respectively are applied with positive (+), negative (−) and positive (+) driving voltages; the sub-pixels R, the sub-pixels G and the sub-pixels B in the second column of pixel units C12 respectively are applied with negative (−), positive (+) and negative (−) driving voltages; and the sub-pixels R, the sub-pixels G and the sub-pixels B in the third column of pixel units C13 respectively are applied with negative (−), positive (+) and negative (−) driving voltages; so that in the same pixel unit group, each successively arranged three columns of pixel units have adjacent two columns of pixel units with driving voltages of a same polarity distribution.

In an embodiment, the driving method further includes: using driving voltages of opposite polarities to respectively drive each adjacent two sub-pixels in a same pixel unit. As such, it can make liquid crystal molecules in the same pixel unit have different deflection angles and thereby improve the color shift phenomenon.

In an actual application, when the display panel is a liquid crystal display panel, taking into account that when a direct current (DC) electric field drives the liquid crystal pixels, it would easily lead to chemical reaction of a liquid crystal material and accelerate the aging of electrodes so that the lifespan of the display panel is shortened, in an embodiment, in order to protect the liquid crystal material and the electrodes and extend the life of the display panel, each sub-pixel in the display panel is driven in an alternating current (AC) manner. In particular, for a same sub-pixel, in each adjacent two frame display periods, driving voltages of different polarities are respectively applied to achieve an AC driving effect. For example, the driving method further includes: in each adjacent two frame display periods, using driving voltages of opposite polarities to drive a same sub-pixel; or, for each sub-pixel, a polarity of a voltage applied thereto in each frame display period is opposite to the polarity of the voltage applied thereto in the previous frame display period. For example, in an mth frame display period, some sub-pixels in the display panel are applied with the driving voltages as shown in FIG. 3, and in an (m+1)th frame display period, the some sub-pixels in the display panel are applied with the driving voltages as shown in FIG. 4. As such, in each adjacent two frame display periods, the driving voltage polarity of a same sub-pixel is changed while the driving voltage level is kept unchanged.

As an embodiment, during driving the display panel, for each sub-pixel, its driving voltage level is determined according to the pixel unit which the sub-pixel belongs to, and its driving voltage polarity is determined according to the pixel unit group or unit sub-group which the sub-pixel belongs to, and thereby the driving voltage of each sub-pixel can be obtained according to a image data of the sub-pixel and the corresponding driving voltage polarity and level, and then the driving voltage is applied onto the sub-pixel via a data line.

When the above driving method of a display panel is adopted, it may drive the display panel to display several particular testing images as shown in FIG. 5*a*, FIG. 5*b*, FIG. 5*c*, FIG. 5*d*, FIG. 5*e*, FIG. 5*f*, FIG. 5*g* and FIG. 5*h*. In the figures, each sub-pixel filled with diagonal black lines represents a data signal of the sub-pixel being a dark-state signal. Based on experiments, it has been found that displays from flicker images in FIG. 5*a* and FIG. 5*b* to an image in FIG. 5*h* have no color shift problem, the image in FIG. 5*c* can avoid crosstalk in the horizontal direction, and the image in FIG. 5*d* has no color shift. FIG. 5*d* represents an image of bright and dark alternate display using everyone pixel unit as a unit, FIG. 5*e* represents an image of bright and dark alternate display using every two pixel units as a unit, FIG. 5*f* represents an image of bright and dark alternate display using everyone sub-pixel as a unit, FIG. 5*g* represents an image of bright and dark alternate display using every one column of sub-pixels as a unit, and FIG. 5*h* represents an image of bright and dark alternate display using every one column of pixel units as a unit. Therefore, the driving method of a display panel according to the embodiment of the disclosure can achieve good color shift improving effect.

Another embodiment of the disclosure provides a driving apparatus 60 of a display panel. The display panel has multiple pixel units arranged in an array. The multiple pixel units include several first pixel units and several second pixel units. The first pixel unit is adjacently disposed with the second pixel unit, and each pixel unit includes multiple sub-pixels.

Referring to FIG. 6, the driving apparatus 60 include a grouping module 610 and a driving module 620. The driving module 620 includes a first driving unit 621, a second driving unit 622 and a third driving unit 623. The grouping module 610 is configured for dividing multiple pixel units of the display panel into several pixel unit groups, wherein each of the pixel unit groups includes adjacent two rows of pixel units. The first driving unit 621 is configured for using driving voltages of different voltage levels to drive each sub-pixel of the first pixel unit and each sub-pixel of the second pixel unit. The second driving unit 622 is configured for using driving voltages of opposite polarities to drive sub-pixels arranged in a same column in each adjacent two of the pixel unit groups. The third driving unit 623 is configured for using driving voltages with a same polarity distribution to drive adjacent two columns of pixel units of each successively arranged three columns of pixel units in a same one of the pixel unit groups. As such, in each row, the number of sub-pixels applied with driving voltages of positive high level (H+) is equal to the number of sub-pixels applied with driving voltages of negative high level (H−), so that the Vcom voltage is prevented from the impact of parasitic capacitance and thereby correctness of image signal is ensured and the occurrence of color shift or abnormal image quality is avoided.

In an embodiment, the grouping module is further configured for dividing each of the pixel unit groups into multiple unit sub-groups, to make each of the unit sub-groups includes six pixel units arranged in three columns and two rows, and the six pixel units arranged in three columns and two rows include a first column of pixel units, a second column of pixel units and a third column of pixel units sequentially arranged in that order. The third driving unit 623 is concretely configured for using driving voltages having a polarity distribution opposite to a polarity distribution of driving voltages for the first column of pixel units to drive the second column of pixel units and the third column of pixel units in the same one of the unit sub-groups. As such, it can ensure that in a same pixel unit group, each successively arranged three columns of pixel units have two adjacent columns of pixel units with driving voltages of a same polarity distribution. Moreover, in a same column, driving voltage changes by taking every two sub-pixels as a unit, so as to avoid frequent and wide-range jumping of multiple voltages outputted from a same data line, and thereby avoid heating or voltage signal distortion of a data driver chip and further improve the display quality of sub-pixels.

For example, the pixel unit includes a first sub-pixel, a second sub-pixel and a third sub-pixel sequentially arranged in that order. The third driving unit includes a first driving sub-unit, a second driving sub-unit and a third driving sub-unit. The first driving sub-unit is configured for: in the same unit sub-group, using driving voltages having a polarity opposite to a polarity of driving voltages for the first sub-pixels in the first column of pixel units to drive the first sub-pixels in the second column of pixel units and the first sub-pixels in the third column of pixel units. The second driving sub-unit is configured for: in the same unit sub-group, using driving voltages having a polarity opposite to a polarity of driving voltages for the second sub-pixels in the first column of pixel units to drive the second sub-pixels in the second column of pixel units and the second sub-pixels in the third column of pixel units. The third driving sub-unit is configured for: in the same unit sub-group, using driving voltages having a polarity opposite to a polarity of driving voltages for the third sub-pixels in the first column of pixel units to drive the third sub-pixels in the second column of pixel units and the third sub-pixels in the third column of pixel units.

In an embodiment, the grouping module is further configured for dividing each of the pixel unit groups into a plurality of unit sub-groups, to make each of the unit sub-groups includes six pixel units arranged in three columns and two rows, and the six pixel units arranged in three columns and two rows include a first column of pixel units, a second column of pixel units and a third column of pixel units sequentially arranged in that order. The third driving unit 623 is concretely configured for using driving voltages having a polarity distribution opposite to a polarity distribution of driving voltages for the third column of pixel units to drive the first column of pixel units and the second column of pixel units in the same one of the unit sub-groups. As such, it can ensure that in a same pixel unit group, each successively arranged three columns of pixel units have two adjacent columns of pixel units with driving voltages of a same polarity distribution. Moreover, in a same column, driving voltage changes by taking every two sub-pixels as a unit, so as to avoid frequent and wide-range jumping of multiple voltages outputted from a same data line, and thereby avoid heating or voltage signal distortion of a data driver chip and further improve the display quality of sub-pixels.

In an embodiment, the driving module further includes: a fourth driving unit, configured for using driving voltages of different polarities to respectively drive each adjacent two sub-pixels in a same pixel unit. As such, it can make liquid crystal molecules in a same pixel unit have different deflection angles and thereby improve the color shift phenomenon.

In an embodiment, the driving module further includes: a fifth driving unit, configured for: in each adjacent two frame display periods, using driving voltages of opposite polarities to alternately drive a same sub-pixel. As such, it can drive sub-pixels in AC driving manner so as to protect the liquid crystal material and electrodes and thereby extend the life of the display panel.

In an embodiment, the first driving unit 621 is configured for: applying driving voltages with a preset first voltage level to sub-pixels in the first pixel unit, and applying driving voltages with a preset second voltage level to the sub-pixels of the second pixel unit. As such, it can ensure each adjacent two pixel units have different driving voltage levels, and each adjacent two sub-pixels in a same pixel unit have opposite driving voltage polarities.

Still another embodiment of the disclosure provides a driving apparatus of a display panel, and the driving apparatus adopts the driving method of a display panel of any one of above embodiments. For example, a driving apparatus of a display panel is implemented by the driving method of a display panel of any one of above embodiments, or, a driving apparatus of a display panel has function modules corresponding to the driving method of a display panel of any one of above embodiments.

The driving method and driving apparatus of a display panel as provided by the disclosure can be applied into a liquid crystal display panel, an OLED (Organic Light-Emitting Diode) display panel, a QLED (Quantum Dot Light Emitting Diodes) display panel, a curved display panel or a flexible display panel, and so on. Moreover, when the liquid crystal display panel is taken for an example, it can be a TN (Twisted Nematic) liquid crystal display panel, an IPS (In-Plane Switching) liquid crystal display panel, a PLS (Plane to Line Switching) liquid crystal display panel, or a MVA (Multi-domain Vertical Alignment) liquid crystal display panel, and so on. The above display panel may be driven by a logic board of a full high-definition (FHD) display panel. That is, the above driving method and driving apparatus of a display panel may be embodied by the logic board of the full high-definition display panel.

Figure 7:
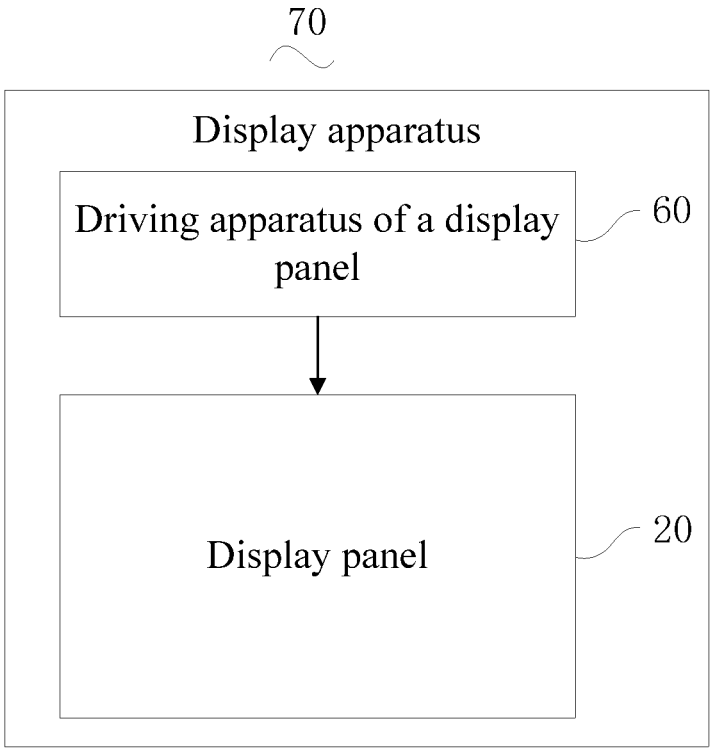
FIG. 7 is a schematic structural view of a display apparatus of an embodiment.

The disclosure further provides a display apparatus. As shown in FIG. 7 the display apparatus 70 includes a display panel 20 and the driving apparatus 60 of a display panel of any one of the above embodiments.

For example, the display apparatus is a liquid crystal display apparatus, an OLED display apparatus, a QLED display apparatus, a curved display apparatus, or a flexible display apparatus, etc. Moreover, when the liquid crystal display apparatus is taken as an example, it can be a TN liquid crystal display apparatus, an IPS liquid crystal display apparatus, a PLS liquid crystal display apparatus, or a MVA liquid crystal display apparatus, and so on.

The technical features of the above embodiments can be combined arbitrarily. In order to make the description concise, not all possible combinations of the various technical features in the above embodiments are described. However, as long as combinations of these technical features have no conflict, they should be regarded as the scope of the disclosure.

The above embodiments merely illustrate several embodiments of the disclosure, whose descriptions are concrete and detailed, but should not be construed as limiting the scope of the disclosure. It should be noted that those skilled in the art may make various modifications and improvements without departing from the concept of the disclosure, all of which fall within the protection scope of the disclosure. Therefore, the protection scope of instant patent application shall be subject to the appended claims.

What is claimed is:

1. A driving method of a display panel, comprising:

dividing a plurality of pixel units of a display panel into a plurality of pixel unit groups, wherein each of the pixel unit groups comprises adjacent two rows of the pixel units, and each of the pixel units comprises sub-pixels;

using driving voltages of different voltage levels to drive the sub-pixels of a first pixel unit of the plurality of pixel units and the sub-pixels of a second pixel unit of the plurality of pixel units;

using driving voltages of opposite polarities to drive the sub-pixels arranged in a same column in each adjacent two of the pixel unit groups; and using driving voltages with a same polarity distribution to drive adjacent two columns of pixel units of each successively arranged three columns of pixel units in a same one of the pixel unit groups;

wherein in each row as well as in each column of pixel units in the display panel, the first pixel unit and the second pixel unit are adjacently disposed;

wherein the using driving voltages of different voltage levels to drive the sub-pixels of a first pixel unit of the plurality of pixel units and the sub-pixels of a second pixel unit of the plurality of pixel units comprises:

applying driving voltages with a preset first voltage level respectively to the sub-pixels in the first pixel unit; and applying driving voltages with a preset second voltage level respectively to the sub-pixels of the second pixel unit;

wherein one of the preset first voltage level and the preset second voltage level is a high voltage level, and the other one of the preset first voltage level and the preset second voltage level is a low voltage level;

wherein the sub-pixels of each of the pixel units comprise a first sub-pixel, a second sub-pixel and a third sub-pixel of different colors, the first sub-pixel, the second sub-pixel and the third sub-pixel are arranged adjacent in that order and along a row;

wherein the driving voltages respectively applied to the first sub-pixel, the second sub-pixel and the third sub-pixel of the first pixel unit all are with the preset first voltage level, and the driving voltage respectively applied to the first sub-pixel, the second sub-pixel and the third sub-pixel of the second pixel unit all are with the preset second voltage level;

wherein in adjacent two frame display periods, the driving voltage for same one sub-pixel is changed in polarity while the driving voltage for the same one sub-pixel is kept unchanged in driving voltage level, the same one sub-pixel is the first sub-pixel, the second sub-pixel or the third sub-pixel.

2. The driving method as claimed in claim 1, further comprising:

dividing each of the pixel unit groups into a plurality of unit sub-groups, wherein each of the unit sub-groups comprises six pixel units arranged in three columns and two rows, and the six pixel units arranged in three columns and two rows comprise a first column of pixel units, a second column of pixel units and a third column of pixel units sequentially arranged in that order;

wherein the step of using driving voltages with a same polarity distribution to drive adjacent two columns of pixel units of each successively arranged three columns of pixel units in a same one of the pixel unit groups comprises:

using driving voltages having a polarity distribution opposite to a polarity distribution of driving voltages for the first column of pixel units to drive the second column of pixel units and the third column of pixel units in the same one of the unit sub-groups.

3. The driving method as claimed in claim 2, wherein the step of using driving voltages having a polarity distribution opposite to a polarity distribution of driving voltages for the first column of pixel units to drive the second column of pixel units and the third column of pixel units in the same one of the unit sub-groups comprises:

in the same unit sub-group, using driving voltages having a polarity opposite to a polarity of driving voltages for the first sub-pixels in the first column of pixel units to drive the first sub-pixels in the second column of pixel units and the first sub-pixels in the third column of pixel units;

in the same unit sub-group, using driving voltages having a polarity opposite to a polarity of driving voltages for the second sub-pixels in the first column of pixel units to drive the second sub-pixels in the second column of pixel units and the second sub-pixels in the third column of pixel units;

in the same unit sub-group, using driving voltages having a polarity opposite to a polarity of driving voltages for the third sub-pixels in the first column of pixel units to drive the third sub-pixels in the second column of pixel units and the third sub-pixels in the third column of pixel units.

4. The driving method as claimed in claim 1, further comprising:

dividing each of the pixel unit groups into a plurality of unit sub-groups, wherein each of the unit sub-groups comprises six pixel units arranged in three columns and two rows, and the six pixel units arranged in three columns and two rows comprise a first column of pixel units, a second column of pixel units and a third column of pixel units sequentially arranged in that order;

wherein the step of using driving voltages with a same polarity distribution to drive adjacent two columns of pixel units of each successively arranged three columns of pixel units in a same one of the pixel unit groups comprises:

using driving voltages having a polarity distribution opposite to a polarity distribution of driving voltages for the third column of pixel units to drive the first column of pixel units and the second column of pixel units in the same one of the unit sub-groups.

5. The driving method as claimed in claim 1, wherein the driving method further comprises:

using driving voltages of different polarities to respectively drive each adjacent two sub-pixels in a same pixel unit.

6. A driving apparatus of a display panel, comprising:

a grouping module, configured to divide a plurality of pixel units of a display panel into a plurality of pixel unit groups, wherein each of the pixel unit groups comprises adjacent two rows of the pixel units, the pixel units comprise first pixel units and second pixel units arranged alternately in each row as well as in each column, and each of the pixel units comprises sub-pixels; and a driving module, wherein the driving module comprises:

a first driving unit, configured to use driving voltages of different voltage levels to drive the sub-pixels of the first pixel unit and the sub-pixels of the second pixel unit;

a second driving unit, configured to use driving voltages of opposite polarities to drive the sub-pixels arranged in a same column in each adjacent two of the pixel unit groups;

a third driving unit, configured to use driving voltages with a same polarity distribution to drive adjacent two columns of pixel units of each successively arranged three columns of pixel units in a same one of the pixel unit groups;

wherein the first pixel unit and the second pixel unit are adjacently disposed in the display panel wherein the first driving unit configured to use driving voltages of different voltage levels to drive the sub-pixels of the first pixel unit and the sub-pixels of the second pixel unit is concretely configured to: apply driving voltages with a preset first voltage level to the sub-pixels in the first pixel unit, and apply driving voltages with a preset second voltage level to the sub-pixels of the second pixel unit;

wherein one of the preset first voltage level and the preset second voltage level is a high voltage level, and the other one of the preset first voltage level and the preset second voltage level is a low voltage level;

wherein the sub-pixels of each of the pixel units comprise a first sub-pixel, a second sub-pixel and a third sub-pixel of different colors, the first sub-pixel, the second sub-pixel and the third sub-pixel are arranged adjacent in that order and along a row;

wherein the driving voltages respectively applied to the first sub-pixel, the second sub-pixel and the third sub-pixel of the first pixel unit all are with the preset first voltage level, and the driving voltage respectively applied to the first sub-pixel, the second sub-pixel and the third sub-pixel of the second pixel unit all are with the preset second voltage level;

wherein the driving module further comprises:

a fifth driving unit, configured to: in each adjacent two frame display periods, change the driving voltage for same one sub-pixel in polarity while the driving voltage for the same one sub-pixel is kept unchanged in driving voltage level, the same one sub-pixel is the first sub-pixel, the second sub-pixel or the third sub-pixel.

7. The driving apparatus as claimed in claim 6, wherein the grouping module is further configured to:

divide each of the pixel unit groups into a plurality of unit sub-groups, wherein each of the unit sub-groups comprises six pixel units arranged in three columns and two rows, and the six pixel units arranged in three columns and two rows comprise a first column of pixel units, a second column of pixel units and a third column of pixel units sequentially arranged in that order;

wherein the third driving unit is configured to:

use driving voltages having a polarity distribution opposite to a polarity distribution of driving voltages for the first column of pixel units to drive the second column of pixel units and the third column of pixel units in the same one of the unit sub-groups.

8. The driving apparatus as claimed in claim 7, wherein the sub-pixels of each of the pixel units comprise a first sub-pixel, a second sub-pixel and a third sub-pixel sequentially arranged in that order;

wherein the third driving unit comprises:

a first driving sub-unit, configured to: in the same unit sub-group, use driving voltages having a polarity opposite to a polarity of driving voltages for the first sub-pixels in the first column of pixel units to drive the first sub-pixels in the second column of pixel units and the first sub-pixels in the third column of pixel units;

a second driving sub-unit, configured to: in the same unit sub-group, use driving voltages having a polarity opposite to a polarity of driving voltages for the second sub-pixels in the first column of pixel units to drive the second sub-pixels in the second column of pixel units and the second sub-pixels in the third column of pixel units;

a third driving sub-unit, configured to: in the same unit sub-group, use driving voltages having a polarity opposite to a polarity of driving voltages for the third sub-pixels in the first column of pixel units to drive the third sub-pixels in the second column of pixel units and the third sub-pixels in the third column of pixel units.

9. The driving apparatus as claimed in claim 6, wherein the grouping module is further configured to:

divide each of the pixel unit groups into a plurality of unit sub-groups, wherein each of the unit sub-groups comprises six pixel units arranged in three columns and two rows, and the six pixel units arranged in three columns and two rows comprise a first column of pixel units, a second column of pixel units and a third column of pixel units sequentially arranged in that order;

wherein the third driving unit is configured to:

use driving voltages having a polarity distribution opposite to a polarity distribution of driving voltages for the third column of pixel units to drive the first column of pixel units and the second column of pixel units in the same one of the unit sub-groups.

10. The driving apparatus as claimed in claim 6, wherein the driving module further comprises:

a fourth driving unit, configured to use driving voltages of different polarities to respectively drive each adjacent two sub-pixels in a same pixel unit.

11. A display apparatus comprising:

a display panel; and a driving apparatus;

wherein the driving apparatus comprises:

a grouping module, configured to divide a plurality of pixel units of a display panel into a plurality of pixel unit groups, wherein each of the pixel unit groups comprises adjacent two rows of the pixel units, the pixel units comprise first pixel units and second pixel units arranged alternately in each row as well as in each column, and each of the pixel units comprises consists of sub-pixels; and a driving module, wherein the driving module comprises:

a first driving unit, configured to use driving voltages of different voltage levels to drive the sub-pixels of the first pixel unit and the sub-pixels of the second pixel unit;

a second driving unit, configured to use driving voltages of opposite polarities to drive the sub-pixels arranged in a same column in each adjacent two of the pixel unit groups;

a third driving unit, configured to use driving voltages with a same polarity distribution to drive adjacent two columns of pixel units of each successively arranged three columns of pixel units in a same one of the pixel unit groups;

wherein the first pixel unit and the second pixel unit are adjacently disposed in the display panel;

wherein the first driving unit configured to use driving voltages of different voltage levels to drive the sub-pixels of the first pixel unit and the sub-pixels of the second pixel unit is concretely configured to: apply driving voltages with a preset first voltage level to the sub-pixels in the first pixel unit, and apply driving voltages with a preset second voltage level to the sub-pixels of the second pixel unit;

wherein one of the preset first voltage level and the preset second voltage level is a high voltage level, and the other one of the preset first voltage level and the preset second voltage level is a low voltage level;

wherein the sub-pixels of each of the pixel units consist of a first sub-pixel, a second sub-pixel and a third sub-pixel of different colors, the first sub-pixel, the second sub-pixel and the third sub-pixel are arranged adjacent in that order and along a row;

wherein the driving voltages respectively applied to the first sub-pixel, the second sub-pixel and the third sub-pixel of the first pixel unit all are with the preset first voltage level, and the driving voltage respectively applied to the first sub-pixel, the second sub-pixel and the third sub-pixel of the second pixel unit all are with the preset second voltage level;

wherein the driving module further comprises:

a fifth driving unit, configured to: in each adjacent two frame display periods, change the driving voltage for same one sub-pixel in polarity while the driving voltage for the same one sub-pixel is kept unchanged in driving voltage level, the same one sub-pixel is the first sub-pixel, the second sub-pixel or the third sub-pixel.

12. The display apparatus as claimed in claim 11, wherein the grouping module is further configured to:

divide each of the pixel unit groups into a plurality of unit sub-groups, wherein each of the unit sub-groups comprises six pixel units arranged in three columns and two rows, and the six pixel units arranged in three columns and two rows comprise a first column of pixel units, a second column of pixel units and a third column of pixel units sequentially arranged in that order;

wherein the third driving unit is configured to:

use driving voltages having a polarity distribution opposite to a polarity distribution of driving voltages for the first column of pixel units to drive the second column of pixel units and the third column of pixel units in the same one of the unit sub-groups.

13. The display apparatus as claimed in claim 12, wherein the sub-pixels of each of the pixel units comprise a first sub-pixel, a second sub-pixel and a third sub-pixel sequentially arranged in that order;

wherein the third driving unit comprises:

a first driving sub-unit, configured to: in the same unit sub-group, use driving voltages having a polarity opposite to a polarity of driving voltages for the first sub-pixels in the first column of pixel units to drive the first sub-pixels in the second column of pixel units and the first sub-pixels in the third column of pixel units;

a second driving sub-unit, configured to: in the same unit sub-group, use driving voltages having a polarity opposite to a polarity of driving voltages for the second sub-pixels in the first column of pixel units to drive the second sub-pixels in the second column of pixel units and the second sub-pixels in the third column of pixel units;

a third driving sub-unit, configured to: in the same unit sub-group, use driving voltages having a polarity opposite to a polarity of driving voltages for the third sub-pixels in the first column of pixel units to drive the third sub-pixels in the second column of pixel units and the third sub-pixels in the third column of pixel units.

14. The display apparatus as claimed in claim 11, wherein the grouping module is further configured to:

divide each of the pixel unit groups into a plurality of unit sub-groups, wherein each of the unit sub-groups comprises six pixel units arranged in three columns and two rows, and the six pixel units arranged in three columns and two rows comprise a first column of pixel units, a second column of pixel units and a third column of pixel units sequentially arranged in that order;

wherein the third driving unit is configured to:

use driving voltages having a polarity distribution opposite to a polarity distribution of driving voltages for the third column of pixel units to drive the first column of pixel units and the second column of pixel units in the same one of the unit sub-groups.

15. The display apparatus as claimed in claim 11, wherein the driving module further comprises:

a fourth driving unit, configured to use driving voltages of different polarities to respectively drive each adjacent two sub-pixels in a same pixel unit.

* * * * *